US008841055B2

(12) United States Patent
Zhou et al.

(10) Patent No.: US 8,841,055 B2
(45) Date of Patent: Sep. 23, 2014

(54) SUPER LOW MELT EMULSION AGGREGATION TONERS COMPRISING A TRANS-CINNAMIC DI-ESTER

(75) Inventors: Ke Zhou, Oakville (CA); Adela Goredema, Mississauga (CA); Karen Moffat, Brantford (CA); Edward G. Zwartz, Mississauga (CA); Mike Hawkins, Cambridge (CA); Rosa Duque, Brampton (CA); Guerino G. Sacripante, Oakville (CA)

(73) Assignee: Xerox Corporation, Norwalk, CT (US)

( * ) Notice: Subject to any disclaimer, the term of this patent is extended or adjusted under 35 U.S.C. 154(b) by 81 days.

(21) Appl. No.: 13/439,304

(22) Filed: Apr. 4, 2012

(65) Prior Publication Data

US 2013/0266896 A1 Oct. 10, 2013

(51) Int. Cl.
*G03G 9/00* (2006.01)

(52) U.S. Cl.
USPC ..... 430/108.4; 430/109.1; 430/109.4; 430/137.1

(58) Field of Classification Search
USPC ..... 430/108.1–108.4, 109.1, 109.4
See application file for complete search history.

(56) References Cited

U.S. PATENT DOCUMENTS

| | | | |
|---|---|---|---|
| 5,057,392 | A | 10/1991 | McCabe et al. |
| 5,147,747 | A | 9/1992 | Wilson et al. |
| 5,278,020 | A | 1/1994 | Grushkin et al. |
| 5,290,654 | A | 3/1994 | Sacripante et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,723,253 | A | 3/1998 | Higashino et al. |
| 5,744,520 | A | 4/1998 | Kmiecik-Lawrynowicz et al. |
| 5,747,215 | A | 5/1998 | Ong et al. |
| 5,763,133 | A | 6/1998 | Ong et al. |
| 5,766,818 | A | 6/1998 | Smith et al. |
| 5,804,349 | A | 9/1998 | Ong et al. |

(Continued)

FOREIGN PATENT DOCUMENTS

| | | |
|---|---|---|
| GB | 1442835 | 7/1976 |

*Primary Examiner* — Mark F Huff
*Assistant Examiner* — Rashid Alam
(74) *Attorney, Agent, or Firm* — Pillsbury Winthrop Shaw Pittman LLP

(57) ABSTRACT

An emulsion aggregation toner composition is disclosed that includes toner particles with at least one small crystalline molecule, such as a trans-cinnamic diester, at least one amorphous resin, optional waxes, coagulants, pigments, and combinations thereof. In other embodiments, the small crystalline molecule is biodegradable and can be made using raw materials derived from renewable resources. Such small crystalline molecules are also compatible with amorphous binder resins, to provide toner compositions with reduced minimum fusing temperatures without sacrificing electrical performance. Processes for preparing emulsion aggregation toner compositions are also described.

20 Claims, 4 Drawing Sheets

(56) References Cited

U.S. PATENT DOCUMENTS

| | | | | |
|---|---|---|---|---|
| 5,827,633 | A | 10/1998 | Ong et al. | |
| 5,840,462 | A | 11/1998 | Foucher et al. | |
| 5,853,944 | A | 12/1998 | Foucher et al. | |
| 5,863,698 | A | 1/1999 | Patel et al. | |
| 5,869,215 | A | 2/1999 | Ong et al. | |
| 5,902,710 | A | 5/1999 | Ong et al. | |
| 5,910,387 | A | 6/1999 | Mychajlowskij et al. | |
| 5,916,725 | A | 6/1999 | Patel et al. | |
| 5,919,595 | A | 7/1999 | Mychajlowskij et al. | |
| 5,925,488 | A | 7/1999 | Patel et al. | |
| 5,977,210 | A | 11/1999 | Patel et al. | |
| 6,120,967 | A | 9/2000 | Hopper et al. | |
| 6,245,863 | B1 * | 6/2001 | Al Ghatta | 525/437 |
| 6,383,705 | B2 | 5/2002 | Aoki et al. | |
| 6,576,389 | B2 | 6/2003 | Vanbesien et al. | |
| 6,617,092 | B1 | 9/2003 | Patel et al. | |
| 6,627,373 | B1 | 9/2003 | Patel et al. | |
| 6,638,677 | B2 | 10/2003 | Patel et al. | |
| 6,656,657 | B2 | 12/2003 | Patel et al. | |
| 6,656,658 | B2 | 12/2003 | Patel et al. | |
| 6,664,017 | B1 | 12/2003 | Patel et al. | |
| 6,673,505 | B2 | 1/2004 | Jiang et al. | |
| 6,730,450 | B1 | 5/2004 | Moffat et al. | |
| 6,743,559 | B2 | 6/2004 | Combes et al. | |
| 6,756,176 | B2 | 6/2004 | Stegamat et al. | |
| 6,780,500 | B2 | 8/2004 | Dumouchel | |
| 6,780,557 | B2 | 8/2004 | Kawaji et al. | |
| 6,830,860 | B2 | 12/2004 | Sacripante et al. | |
| 6,942,951 | B2 | 9/2005 | Daimon et al. | |
| 7,029,817 | B2 | 4/2006 | Robinson et al. | |
| 7,056,635 | B2 | 6/2006 | Tanaka et al. | |
| 2005/0196691 | A1 * | 9/2005 | Ohtani et al. | 430/105 |
| 2005/0277047 | A1 * | 12/2005 | Tsuji | 430/110.2 |
| 2006/0222991 | A1 | 10/2006 | Sacripante et al. | |
| 2008/0107989 | A1 | 5/2008 | Sacripante et al. | |
| 2008/0236446 | A1 | 10/2008 | Zhou et al. | |
| 2011/0053078 | A1 * | 3/2011 | Zwartz et al. | 430/124.4 |
| 2012/0237870 | A1 * | 9/2012 | Watanabe et al. | 430/109.4 |
| 2013/0131226 | A1 * | 5/2013 | Goredema et al. | 524/57 |
| 2013/0149643 | A1 * | 6/2013 | Moffat et al. | 430/110.1 |
| 2013/0244151 | A1 * | 9/2013 | Chen et al. | 430/105 |

* cited by examiner

SUPER LOW MELT EMULSION AGGREGATION TONERS COMPRISING A TRANS-CINNAMIC DI-ESTER

TECHNICAL FIELD

This disclosure is generally directed to toner compositions, and more specifically, emulsion aggregation toner compositions, as well as emulsion aggregation toner particles and processes of preparing emulsion aggregation toners. More specifically, this disclosure is directed to super low melt emulsion aggregation toilers comprising small crystalline molecules, such as trans-cinnamic di-esters, compatible with toner amorphous binder resins, to provide minimum fusing temperature reduction.

BACKGROUND

Emulsion aggregation (EA) toners are used in forming print and/or xerographic images. EA techniques typically involve the formation of an emulsion of resin that have a small particle size of from about 5 to about 500 nanometers in diameter, by heating the resin, optionally with solvent if needed, in water, or by making a emulsion in water using an emulsion polymerization. An optional colorant dispersion, for example of a pigment dispersed in water, optionally with additional resin, is separately formed. The colorant dispersion is added to the emulsion mixture, and an aggregating agent or complexing agent is then added and/or aggregation is otherwise initiated to form aggregated toner particles. The aggregated toner particles are heated to enable coalescence/fusing, thereby achieving aggregated, fused toner particles. United States patents and application publications describing EA toners are well known.

Two main types of EA toners are known. First is an EA process that forms acrylate based, for example, styrene acrylate, toner particles. See U.S. Pat. No. 6,120,967, the entire disclosure of which is incorporated herein by reference, as one example of such a process. Second is an EA process that forms polyester, for example, sodio sulfonated polyester, toner particles. See U.S. Pat. No. 5,916,725, the entire disclosure of which is incorporated herein by reference, as one example of such a process. Alternatively, toner particles can be formed via an EA process that uses preformed polyester emulsions made using solvent flash or phase inversion emulsification (PIE) such as those toner methods described in U.S. Patent Application Publication No. 2008/0236446, the entire disclosure of which is incorporated herein by reference. Additionally, so-called ultra low melt polyester toners can be obtained by incorporation of a suitable crystalline polyester. Examples of EA ultra low melt (ULM) polyester toners, include those described in U.S. Pat. Nos. 5,057,392; 5,147,747; 6,383,705; 6,780,557; 6,942,951; 7,056,635 and U.S. Patent Application Pub. No. 2008/0236446, the disclosures of which are incorporated by reference in their entirety.

Toner blends containing crystalline or semi-crystalline polyester resins with an amorphous resin have been recently shown to provide very desirable ultra low melt fusing, which is important for both high-speed printing and lower fuser power consumption. These types of toners containing crystalline polyesters have been demonstrated suitable for both EA toners, and in conventional jetted toners. Combinations of amorphous and crystalline polyesters may provide toners with relatively low-melting point characteristics, which allows for more energy efficient and faster printing Currently, ULM polyester based toner products have benchmark crease fix minimum fusing temperature (MFT) of about −20° C. relative to styrene/acrylate EA toners. This improved crease fix MFT performance enables a reduction in fuser energy and enhanced fuser life. The reduction in crease fix MFT is primarily achieved by the introduction of a crystalline polyester resin (about 5 to 10%) into the EA particle design. Although adding more of this crystalline resin does reduce the crease fix MFT even further by about an additional 10° C. (super low melt), conductivity of the crystalline degrades electrical performances of the resulting toner. Accordingly, there is a need to provide a super low melt toner composition. Additionally, there is a need for an EA toner composition with reduced a crease fix MFT of about −30° C. or lower, without sacrificing the electrical performance of the toner.

REFERENCES

In U.S. Patent Application Ser. No. 13/196,227, there is disclosed a phase change ink comprising: (a) a crystalline trans-cinnamic diester; and (b) an amorphous oligomer of isosorbide and a diacid.

SUMMARY

Disclosed herein is a toner composition comprising toner particles comprising: at least one small crystalline molecule; at least one amorphous resin; and optionally, one or more ingredients selected from the group consisting of waxes, coagulants, pigments, and combinations thereof, wherein the at least one small crystalline molecule is one or more trans-cinnamic diesters having a general formula

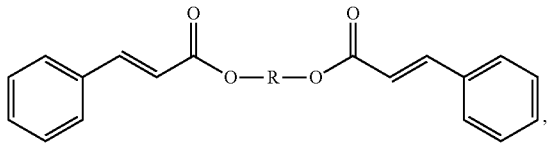

wherein R is: (a) an alkylene group, including substituted and unsubstituted alkylene groups, and wherein hetero atoms either may or may not be present in the alkylene group; (b) an arylene group, including substituted and unsubstituted arylene groups, and wherein hetero atoms either may or may not be present in the arylene group; (c) an arylalkylene group, including substituted and unsubstituted arylalkylene groups, and wherein hetero atoms either may or may not be present in either or both of the alkyl portion and the aryl portion of the arylalkylene group; or (d) an alkylarylene group, including substituted and unsubstituted alkylarylene groups, and wherein hetero atoms either may or may not be present in either or both of the alkyl portion and the aryl portion of the alkylarylene group; wherein two or more substituents can be joined together to form a ring.

Also disclosed herein is an emulsion aggregation toner composition comprising toner particles comprising: at least one small crystalline molecule; at least one amorphous resin; and optionally, one or more ingredients selected from the group consisting of waxes, coagulants, pigments, and combinations thereof, wherein the at least one small crystalline molecule is one or more trans-cinnamic diesters having a general formula

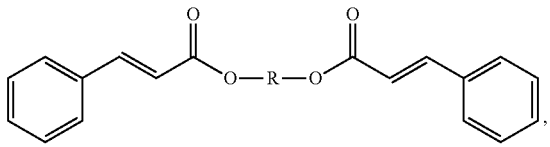

wherein R is: (a) an alkylene group, including substituted and unsubstituted alkylene groups, and wherein hetero atoms either may or may not be present in the alkylene group; (b) an arylene group, including substituted and unsubstituted arylene groups, and wherein hetero atoms either may or may not be present in the arylene group; (c) an arylalkylene group, including substituted and unsubstituted arylalkylene groups, and wherein hetero atoms either may or may not be present in either or both of the alkyl portion and the aryl portion of the arylalkylene group; or (d) an alkylarylene group, including substituted and unsubstituted alkylarylene groups, and wherein hetero atoms either may or may not be present in either or both of the alkyl portion and the aryl portion of the alkylarylene group; wherein two or more substituents can be joined together to form a ring.

Further disclosed herein is an emulsion aggregation process for preparing a toner, comprising: contacting at least one amorphous resin with at least one small crystalline molecule in a mixture; and contacting the mixture with one or more ingredients selected from the group consisting of waxes, coagulants, pigments, and combinations thereof to form toner particles, wherein the at least one small crystalline molecule is one or more trans-cinnamic diesters having a general formula

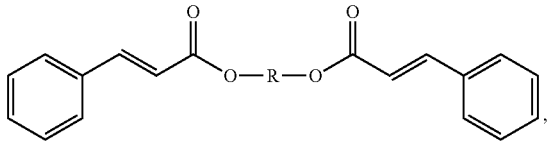

wherein R is: (a) an alkylene group, including substituted and unsubstituted alkylene groups, and wherein hetero atoms either may or may not be present in the alkylene group; (b) an arylene group, including substituted and unsubstituted arylene groups, and wherein hetero atoms either may or may not be present in the arylene group; (c) an arylalkylene group, including substituted and unsubstituted arylalkylene groups, and wherein hetero atoms either may or may not be present in either or both of the alkyl portion and the aryl portion of the arylalkylene group; or (d) an alkylarylene group, including substituted and unsubstituted alkylarylene groups, and wherein hetero atoms either may or may not be present in either or both of the alkyl portion and the aryl portion of the alkylarylene group; wherein two or more substituents can be joined together to form a ring.

EMBODIMENTS

Figure 1:
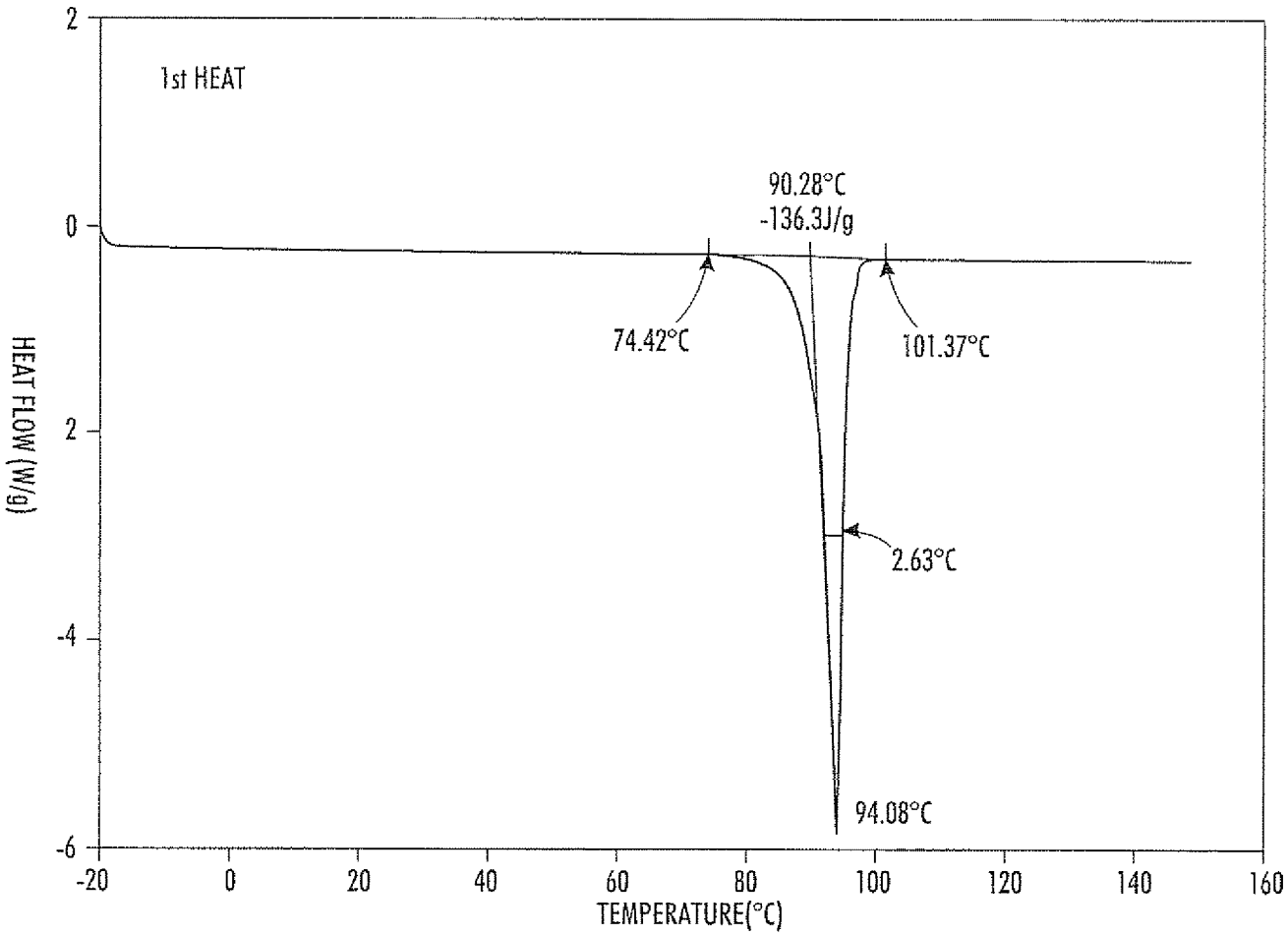
FIG. 1 is a graphic representation of a differential scanning calorimetry curve acquired on a crystalline cinnamate diester sample.

In this specification and the claims that follow, singular forms such as "a," "an," and "the" include plural forms unless the content clearly dictates otherwise. All ranges disclosed herein include, unless specifically indicated, all endpoints and intermediate values. In addition, reference may be made to a number of terms that shall be defined as follows:

"Optional" or "optionally" refers, for example, to instances in which subsequently described circumstance may or may not occur, and include instances in which the circumstance occurs and instances in which the circumstance does not occur.

The terms "one or more" and "at least one" refer, for example, to instances in which one of the subsequently described circumstances occurs, and to instances in which more than one of the subsequently described circumstances occurs.

The term "minimum fusing temperature (MFT)" refers, for example, to the minimum temperature at which an acceptable adhesion of the toner to the support medium occurs.

The term "fusing latitude" refers, for example, to the difference between the MFT and hot offset temperature.

The term "hot offset temperature (HOT)" refers, for example, to the maximum temperature at which the toner does not adhere to the fuser roll.

The term "cold offset temperature (COT)" refers, for example, lower temperature limit where toner fails to adhere to the substrate due to insufficient pressure and/or temperature and sections of the image offset to the fuser roll.

The term "offsetting" refers, for example, to a phenomenon that occurs when some of the molten toner adheres to the fuser roll during fusing and is transferred to subsequent substrates containing developed images, resulting in blurred images.

The toner compositions of the present disclosure are comprised of toner particles having at least a small crystalline molecule, a resin, such as, for example, an amorphous polyester resin, and optional waxes, coagulants, pigments, and combinations thereof. In embodiments, the small crystalline molecule may be one or more trans-cinnamic diesters that may have a substituted group including an alkylene group, an arylene group, an arylalkylene group or an alkylarylene group. Additionally, the toner composition of the present disclosure may have a low crease fix MFT such as, for example, about −20° C. relative to styrene/acrylate EA toners, or about −30° C. (or lower) relative to styrene/acrylate EA toners, or about −40° C. (or lower) relative to styrene/acrylate EA toners. In embodiments, the crease fix MFT may be from about 90° C. to about 140° C., such as from about 100° C. to about 130° C.

In embodiments, the toner composition may have a gloss. The term "gloss units" refers, for example, to Gardner Gloss Units (gu) measured on plain paper (such as Xerox 90 gsm COLOR XPRESSIONS+paper or Xerox 4024 paper). The toners disclosed herein may reach about 40 gloss units (TG40) at a temperature of, for example, from about 110° C. to about 190° C., such as from about 110° C. to about 140° C., or from about 165° C. to about 175° C.

The crease fix MFT may be measured by folding images that have been fused over a wide range of fusing temperatures and then rolling a defined mass across the folded area. The print can also be folded using a commercially available folder such as the Duplo D-590 paper folder. The sheets of paper are then unfolded and toner that has been fractured from the sheet of paper is wiped from the surface. Comparison of the fractured area is then made to an internal reference chart. Smaller fractured areas indicate better toner adhesion and the temperature to achieve acceptable adhesion is defined as the crease fix MFT.

Small Crystalline Molecule

In embodiments, toner compositions, such as emulsion aggregation toner compositions, may include toner particles with at least one small crystalline molecule. In one embodiment, the small crystalline molecule may be a trans-cinnamic diester. Such crystalline diester compounds may be biodegradable, and materials making up these crystalline diester compounds may also be made using raw materials derived from renewable resources.

Examples of suitable trans-cinnamic diesters include, for example, those of the general formula

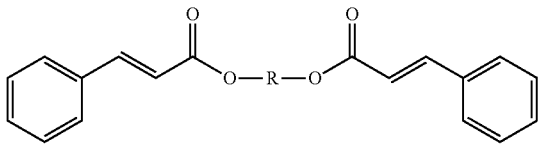

wherein R is (1) an alkylene group, including linear, branched, saturated unsaturated, cyclic, substituted, and unsubstituted alkylene groups, and wherein hetero atoms, such as oxygen, nitrogen, sulfur, silicon, phosphorus, boron, and the like either may or may not be present in the alkylene group, in one embodiment with at least about 2 carbon atoms, in another embodiment with at least about 3 carbon atoms, and yet in another embodiment with at least about 4 carbon atoms, and in one embodiment with no more than about 20 carbon atoms, in another embodiment with not more than about 10 carbon atoms, and in yet another embodiment, with no more than about 8 carbon atoms.

In another embodiment, R may also be an arylene group, including substituted and unsubstituted arylene groups, and wherein hetero atoms, such as oxygen, nitrogen, sulfur, silicon, phosphorus, boron, and the like either may or may not be present in the arylene group, in one embodiment with at least about 6 carbon atoms, in another embodiment with at least about 7 carbon atoms, and yet in another embodiment with at least about 8 carbon atoms, in another embodiment with no more than about 20 carbon atoms, in another embodiment with no more than about 18 carbon atoms, and in yet another embodiment with no more than about 16 carbon atoms, such as phenylene or the like.

In yet another embodiment, R may also be an arylalkylene group, including substituted and unsubstituted arylalkylene groups, wherein the alkyl portion of the arylalkylene group can be linear, branched, saturated, unsaturated, and/or cyclic, and wherein hetero atoms, such as oxygen, nitrogen, sulfur, silicon, phosphorus, boron, and the like either may or may not be present in either or both of the alkyl portion and the aryl portion of the arylalkylene group, in one embodiment with at least about 7 carbon atoms, in another embodiment with at least about 8 carbon atoms, and yet in another embodiment with at least about 9 carbon atoms, and in one embodiment with no more than about 20 carbon atoms, in another embodiment with no more than about 18 carbon atoms, and yet in another embodiment with no more than about 16 carbon atoms, such as benzylene or the like.

In another embodiment, R may also be an alkylarylene group, including substituted and unsubstituted alkylarylene groups, wherein the alkyl portion of the alkylarylene group can be linear, branched, saturated, unsaturated, and/or cyclic, and wherein hetero atoms, such as oxygen, nitrogen, sulfur, silicon, phosphorus, boron, and the like either may or may not be present in either or both of the alkyl portion and the aryl portion of the alkylarylene group, in one embodiment, with at least about 7 carbon atoms, in another embodiment with at least about 9 carbon atoms, and in one embodiment with no more than about 20 carbon atoms, in another embodiment with no more than about 18 carbon atoms, and in yet another embodiment with no more than about 16 carbon atoms, such as tolylene or the like, and wherein the substituents on the substituents on the substituted alkylene, arylene, arylalkylene, and alkylarylene groups can be, for example, hydroxy groups, halogen atoms, ammonium groups, pyridine groups, pyridinium groups, ether groups, aldehyde groups, ketone groups, amide groups, carbonyl groups, thiocarbonyl groups, sulfate groups, sulfonate groups, sulfonic acid groups, sulfide groups, sulfoxide groups, phosphine groups, phosphonium groups, phosphate groups, nitrile groups, mercapto groups, nitro groups, nitroso groups, sulfone groups, acyl groups, acid anhydride groups, azide groups, isothiocyanato groups, carboxylate groups, carboxylic acid groups, urethane groups, urea groups, mixtures thereof, and the like.

In yet another embodiment, two or more of the above-listed substituents of R can be joined together to form a ring. For example, two or more of a single substituent (for example, an alkylene group, an arylene group, an arylalkylene group, or an alkylarylene group), or two substituents selected from the group consisting of an alkylene group, an arylene group, an arylalkylene group, or an alkylarylene group, may be joined together to form a ring; where an alkylene group may include substituted and unsubstituted alkylene groups, and wherein hetero atoms either may or may not be present in the alkylene group; an arylene group may include substituted and unsubstituted arylene groups, and wherein hetero atoms either may or may not be present in the arylene group; an arylalkylene group may include substituted and unsubstituted arylalkylene groups, and wherein hetero atoms either may or may not be present in either or both of the alkyl portion and the aryl portion of the arylalkylene group; or an alkylarylene group may include substituted and unsubstituted alkylarylene groups, and wherein hetero atoms either may or may not be present in either or both of the alkyl portion and the aryl portion of the alkylarylene group.

Suitable trans-cinnamic acid derived diesters include, for example, propane-1,3-trans-cinnamate, butane-1,4-trans-cinnamate, hexane-1,6-trans-cinnamate, trans-cyclohexane-1,4-dimethanol-trans-cinnamate, para-phenyl 1,4-dimethanol-trans-cinnamate, bis(hydroxymethyl)furan-trans-cinnamate, 2,5-dihydroxymethyl-tetrahydrofuran-trans-cinnamate, and the like, as well as mixtures thereof.

In another embodiment, the EA toner composition may include toner particles including an amount of the small crystalline molecule up to about 50% by weight of the toner particles on a dry weight basis, such as from about 2.5% to about 40%, or from about 5% to about 30%.

Resin

In embodiments, the amorphous resin of the toner composition of the present disclosure may include polyester resins and/or its derivatives, including polyester resins and branched polyester resins, alkali sulfonated-polyester resins, branched alkali sulfonated-polyester resins. In one embodiment, the resin may include a crystalline polyester resin. More specifically, the resin may include an amount of the crystalline polyester resin in an amount of from about 0% to about 50%, specifically from about 2% to about 40%, more specifically from about 5% to about 30% by weight of the toner particles on a dry weight basis.

Illustrative examples of amorphous polyester resins selected for the process and particles of the present disclosure include any of the various amorphous polyesters, such as polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene-isophthalate, polypropylene-isophthalate, polybutylene-isophthalate, polypentylene-isophthalate, polyhexalene-isophthalate, polyheptadene-isophthalate, polyoctalene-isophthalate, polyethylene-sebacate, polypropylene sebacate, polybutylene-sebacate, polyethylene-adipate, polypropylene-adipate, polybutylene-adipate, polypentylene-adipate, polyhexalene-adipate, polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate polyethylene-pimelate, polypropylene-pimelate, polybutylene-pimelate, polypentylene-pimelate, polyhexalene-pimelate, polyheptadene-pimelate, poly(ethoxylated bisphenol A-fumarate), poly(ethoxylated bisphenol A-succinate), poly (ethoxylated bisphenol A-adipate), poly(ethoxylated bisphenol A-glutarate), poly(ethoxylated bisphenol A-terephthalate), poly(ethoxylated bisphenol A-isophthalate), poly (ethoxylated bisphenol A-dodecenylsuccinate), poly (propoxylated bisphenol A-fumarate), poly(propoxylated bisphenol A-succinate), poly(propoxylated bisphenol A-adipate), poly(propoxylated bisphenol A-glutarate), poly(propoxylated bisphenol A-terephthalate), poly(propoxylated bisphenol A-isophthalate), poly(propoxylated bisphenol A-dodecenylsuccinate), SPAR (Dixie Chemicals), BECKOSOL (Reichhold Inc), ARAKOTE (Ciba-Geigy Corporation), HETRON (Ashland Chemical), PARAPLEX (Rohm & Haas), POLYLITE (Reichhold Inc), PLASTHALL (Rohm & Haas), CYGAL (American Cyanamide), ARMCO (Armco Composites), ARPOL (Ashland Chemical), CELANEX (Celanese Eng), RYNITE (DuPont), STYPOL (Freeman Chemical Corporation) and combinations thereof. The resins can also be functionalized, such as carboxylated, sulfonated, or the like, such as, for example, sodio sulfonated.

In embodiments, suitable amorphous resins may also include polyesters, polyamides, polyimides, polyolefins, polyethylene, polybutylene, polyisobutyrate, ethylene-propylene copolymers, ethylene-vinyl acetate copolymers, polypropylene, combinations thereof, and the like.

The amorphous resin may be, for example, present in an amount of from about 50 to about 99 percent by weight, such as from about 65 to about 90 percent by weight of the toner, which resin may be a branched or linear amorphous polyester resin where amorphous resin can possess, for example, a number average molecular weight ($M_n$), as measured by gel permeation chromatography (GPC), of from about 1,000 to about 500,000, and more specifically, for example, from about 5,000 to about 250,000, a weight average molecular weight ($M_w$) of, for example, from about 5,000 to about 600,000, and more specifically, for example, from about 7,000 to about 300,000, as determined by GPC using polystyrene standards; and wherein the molecular weight distribution ($M_w/M_n$) is, for example, from about 1.5 to about 20, and more specifically, from about 2 to about 10.

Linear amorphous polyester resins suitable for the toners of the present disclosure may be prepared by the polycondensation of an organic diol and a diacid or diester, at least one of which is sulfonated or a sulfonated difunctional monomer being included in the reaction, and a polycondensation catalyst. For the branched amorphous sulfonated polyester resin, the same materials may be used, with the further inclusion of a branching agent such as a multivalent polyacid or polyol.

Other examples of amorphous resins that may be utilized herein include poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly (styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylononitrile-acrylic acid), poly(styrene-butadiene-β-carboxyethyl acrylate), poly (styrene-butadiene-acrylonitrile-β-carboxyethyl acrylate), poly(styrene-butyl acrylate-β-carboxyethyl acrylate), poly (styrene-butyl acrylate-acrylononitrile-β-carboxyethyl acrylate), mixtures thereof, and the like. Such an amorphous resin may possess a weight average molecular weight ($M_w$) of, for example, from about 20,000 to about 55,000, and more specifically, from about 25,000 to about 45,000, a number average molecular weight ($M_n$) of, for example, from about 5,000 to about 18,000, and more specifically, from about 6,000 to about 15,000.

Mixtures of two or more of the above polymers may also be used, if desired.

In embodiments, the present disclosure may further include crystalline polyester resins. Suitable crystalline resins include poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly (octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly (ethylene-decanoate), poly(ethylene dodecanoate), poly (nonylene-sebacate), poly(nonylene-decanoate), copoly(ethylene-fumarate)-copoly(ethylene-sebacate), copoly (ethylene-fumarate)-copoly(ethylene-decanoate), copoly (ethylene-fumarate)-copoly(ethylene-dodecanoate), copoly (2,2-dimethylpropane-1,3-diol-decanoate)-copoly(ethylene-adipate), alkali copoly(5-sulfoisophthaloyl)-copoly (propylene-adipate), alkali copoly(5-sulfoisophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly (5-sulfa-isophthaloyl)-copoly(octylene-adipate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly (hexylene-adipate), alkali copoly(5-sulfo-isophthaloyl)-copoly(octylene-adipate), alkali copoly(5-sulfoisophthaloyl)-copoly(ethylene-succinate), alkali copoly (5-sulfoisophthaloyl)-copoly(propylene-succinate), alkali copoly(5-sulfoisophthaloyl)-copoly(butylenes-succinate), alkali copoly(5-sulfoisophthaloyl)-copoly(pentylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly (ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfa-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly (butylene-adipate), alkali copoly(5-sulfo-isophthaloyl)-copoly(pentylene-adipate), alkali copoly(5-sulfo-isophthaloyl)-copoly(hexylene-adipatenonylene-decanoate), poly(octylene-adipate), and so on, wherein alkali is a metal like sodium, lithium or potassium. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), and poly (propylene-sebecamide). Examples of polyimides include poly(ethylene-adipimide), poly(propylene-adipimide), poly (butylene-adipimide), poly(pentylene-adipimide), poly (hexylene-adipimide), poly(octylene-adipimide), poly(ethylene-succinimide), polypropylene-succinimide), and poly (butylene-succinimide).

Suitable crystalline resins which may be utilized, optionally in combination with an amorphous resin as described above, include those disclosed in U.S. Pub. No. 2006/0222991, the disclosure of which is hereby incorporated by reference in entirety.

In embodiments, a suitable crystalline resin may include a resin formed of ethylene glycol and a mixture of dodecanedioic acid and fumaric acid comonomers. The crystalline resin may be present, for example, in an amount from about 1 to about 50% by weight of the toner components, in embodiments from about 2 to about 30% by weight of the toner components, in embodiments from about 5 to about 15% by weight of the toner components. The crystalline resin can possess various melting points of, for example, from about 30° C. to about 120° C., in embodiments from about 50° C. to about 90° C., in embodiments from about 60° C. to about 80° C. The crystalline resin may have a number average molecular weight (Mn), as measured by gel permeation chromatography (GPC) of, for example, from about 1,000 to about 50,000, in embodiments from about 2,000 to about 25,000, and a weight average molecular weight (Mw) of, for example, from about 2,000 to about 100,000, in embodiments from about 3,000 to about 80,000, as determined by GPC using polystyrene standards. The molecular weight distribution (Mw/Mn) of the crystalline resin may be, for example, from about 2 to about 6, in embodiments from about 3 to about 4.

Compatibility of the above crystalline diester and amorphous toner binding resin may be assessed by mixing the appropriate resins on a hot plate over a 20 minute period (150° C.), followed by cooling and characterization by DSC. In embodiments, the crystalline diesters may display a melting peak at around 70-80° C. whereas the amorphous resin displays a Tg at about 50-60° C. With incompatible resins, both the corresponding Tg and melting point of the mixtures remain unaffected. In embodiments, if the resins are fully compatible, the Tg is depressed and no melting point is observed. For partial compatibility, the Tg is somewhat depressed and the melting point is decreased. To measure the extent of compatibilization, the enthalpy of crystallization is measured. For full compatibility, a value of less than about 0.2 mW is obtained, whereas for full incompatibility, a value of greater than about 4.0 mW is measured by DSC. In embodiments, the mixing the crystalline and amorphous components results in an enthalpy of crystallization less than about 3.0 mW, such as about less than about 1.0 mW, or less than about 0.4 mW, or less than about 0.2 mW.

Colorant

The EA toner particles may also include at least one colorant. For example, colorants or pigments as used herein include pigment, dye, mixtures of pigment and dye, mixtures of pigments, mixtures of dyes, and the like. For simplicity, the term "colorant" as used herein is meant to encompass such colorants, dyes, pigments, and mixtures, unless specified as a particular pigment or other colorant component. The colorant may comprise a pigment, a dye, mixtures thereof, carbon black, magnetite, black, cyan, magenta, yellow, red, green, blue, brown, mixtures thereof, in an amount of from about 0.1% to about 35% by weight based upon the total weight of the composition, such as from about 1% to about 25% by weight. It is to be understood that other useful colorants will become readily apparent based on the present disclosure.

In embodiments where the toner composition is used as an overcoat, for example, to protect an underlying toner image, the toner composition desirably does not include a colorant and thus is clear and colorless. When used as such an overcoat, the toner composition may variously be applied to an entire surface of an imaging substrate (such as a sheet of paper), or it may be applied to only a portion of the imaging substrate, such as only over an already applied toner image. However, in embodiments where the toner composition is used to form a visible toner image, the toner composition desirably does include one or more desired colorants.

In general, useful colorants may include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD Red (Aldrich), Lithol Rubine Toner (Paul Uhlrich), Lithol Scarlet 4440, NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Uhlrich), Lumogen Yellow D0790 (BASF), Suco-Gelb 1250 (BASF), Suco-Yellow D1355 (BASF), Suco Fast Yellow D1165, D1355 and D1351 (BASF), Hostaperm Pink E (Hoechst), Fanal Pink D4830 (BASF), Cinquasia Magenta (DuPont), Paliogen Black L9984 9BASF), Pigment Black K801 (BASF) and particularly carbon blacks such as REGAL 330 (Cabot), Carbon Black 5250 and 5750 (Columbian Chemicals), and the like, and mixtures thereof.

Additional useful colorants may include pigments in water based dispersions such as those commercially available from Sun Chemical, for example SUNSPERSE BHD 6011X (Blue 15 Type), SUNSPERSE BHD 9312 (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226) and the like, and mixtures thereof. Other useful water based colorant dispersions include those commercially available from Clariant, for example, HOSTAFINE Yellow GR, HOSTAFINE Black T and Black TS, HOSTAFINE Blue B2G, HOSTAFINE Rubine F6B and magenta dry pigment such as Toner Magenta 6BVP2213 and Toner Magenta EO2 which can be dispersed in water and/or surfactant prior to use.

Other useful colorants may include, for example, magnetites, such as Mobay magnetites M08029, M08960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TIM-104; and the like or mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlrich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI-60710, CI Dispersed Red 15, diazo dye identified in the Color Index as CI-26050, CI Solvent Red 19, and the like or mixtures thereof. Illustrative examples of cyans include copper tetra (octadecyl sulfonamide) phthalocyanine, x-copper phthalocyanine pigment listed in the Color Index as CI74160, CI Pigment Blue, and Anthrathrene Blue identified in the Color Index as DI 69810, Special Blue X-2137, and the like or mixtures thereof. Illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICOBLACK and cyan components may also be selected as pigments.

Waxes

In embodiments, the EA toner composition may include one or more waxes. In these embodiments, the emulsion will include resin and wax particles at the desired loading levels, which allows for a single resin and wax emulsion to be made rather than separate resin and wax emulsions. The combined emulsion allows for reduction in the amount of surfactant needed to prepare separate emulsions for incorporation into toner compositions. This is particularly helpful in instances where it would otherwise be difficult to incorporate the wax into the emulsion. However, the wax may also be separately emulsified, such as with a resin, and separately incorporated into final products.

Waxes used in embodiments may include either a single type of wax or a mixture of two or more preferably different waxes. A single wax can be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

Suitable examples of waxes include waxes selected from natural vegetable waxes, natural animal waxes, mineral waxes, synthetic waxes, and functionalized waxes. Examples of natural vegetable waxes include, for example, carnauba wax, candelilla wax, rice wax, sumacs wax, jojoba oil, Japan wax, and bayberry wax. Examples of natural animal waxes include, for example, beeswax, panic wax, lanolin, lac wax, shellac wax, and spermaceti wax. Mineral-based waxes include, for example, paraffin wax, microcrystalline wax, montan wax, ozokerite wax, ceresin wax, petrolatum wax, and petroleum wax. Synthetic waxes include, for example, Fischer-Tropsch wax; acrylate wax; fatty acid amide wax; silicone wax; polytetrafluoroethylene wax; polyethylene wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate; and cholesterol higher fatty acid ester waxes, such as cholesteryl stearate; polypropylene wax; and mixtures thereof.

In some embodiments, the wax may be selected from polypropylenes and polyethylenes commercially available from Allied Chemical and Baker Petrolite (for example POLYWAX polyethylene waxes from Baker Petrolite), wax emulsions available from Michelman Inc. and the Daniels Products Company, EPOLENE N-15 commercially available from Eastman Chemical Products, Inc., VISCOL 550-P, a low weight average molecular weight polypropylene available from Sanyo Kasei K.K., and similar materials. The commercially available polyethylenes usually possess a molecular weight ($M_w$) of from about 500 to about 2,000, such as from about 1,000 to about 1,500, while the commercially available polypropylenes have a molecular weight of about 1,000 to about 10,000. Examples of functionalized waxes include amines, amides, imides, esters, quaternary amines, carboxylic acids, or acrylic polymer emulsion, for example, JONCRYL 74, 89, 130, 537, and 538, all available from Johnson Diversey, Inc., chlorinated polypropylenes, and polyethylenes commercially available from Allied Chemical and Petrolite Corporation and Johnson Diversey, Inc. The polyethylene and polypropylene compositions may be selected from those illustrated in British Pat. No. 1,442,835, the entire disclosure of which is incorporated herein by reference.

Toner compositions may contain the wax in any desired amount, for example, of from about 1% to about 25% by weight of toner, such as from about 3% to about 15% by weight of the toner on a dry weight basis; or from about 5% to about 20% by weight of the toner, such as from about 5% to about 11% by weight of the toner on a dry weight basis.

Coagulants

The EA process for making toners of the present disclosure may optionally include least one coagulant, such as a monovalent metal coagulant, a divalent metal coagulant, a polyion coagulant, or the like. As used herein, "polyion coagulant" refers to a coagulant that is a salt or oxide, such as a metal salt or metal oxide, formed from a metal species having a valence of at least 3, at least 4 or at least 5. Suitable coagulants include, for example, coagulants based on aluminum such as polyaluminum halides such as polyaluminum fluoride and polyaluminum chloride (PAC), polyaluminum silicates such as polyaluminum sulfosilicate (PASS), polyaluminum hydroxide, polyaluminum phosphate, aluminum sulfate, and the like. Other suitable coagulants include tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the coagulant is a polyion coagulant, the coagulants may have any desired number of polyion atoms present. For example, suitable polyaluminum compounds include those having from about 2 to about 13, such as from about 3 to about 8, aluminum ions present in the compound Such coagulants can be incorporated into the toner particles during particle aggregation. As such, the coagulant can be present in the toner particles, exclusive of external additives and on a dry weight basis, in amounts of from about 0% to about 5% by weight of the toner particles, such as from about greater than about 0% to about 3% by weight of the toner particles on a dry weight basis.

Emulsion Aggregation Process

Any suitable EA process may be used and modified in forming the EA toner particles without restriction. Such EA processes generally include the steps of emulsifying, aggregating, coalescencing, washing, and drying. See, for example, U.S. Pat. Nos. 5,278,020; 5,290,654; 5,308,734; 5,344,738; 5,346,797; 5,348,832; 5,364,729; 5,366,841; 5,370,963; 5,403,693; 5,405,728; 5,418,108; 5,496,676; 5,501,935; 5,527,658; 5,585,215; 5,650,255; 5,650,256; 5,723,253; 5,744,520; 5,747,215; 5,763,133; 5,766,818; 5,804,349; 5,827,633; 5,840,462; 5,853,944; 5,863,698; 5,869,215; 5,902,710; 5,910,387; 5,916,725; 5,919,595; 5,925,488; 5,977,210; 6,576,389; 6,617,092; 6,627,373; 6,638,677; 6,656,657; 6,656,658; 6,664,017; 6,673,505; 6,730,450; 6,743,559; 6,756,176; 6,780,500; 6,830,860; and 7,029,817; and U.S. Patent Application Publication No. 2008/0107989, the disclosures of which are hereby incorporated by reference in their entireties. Thus, the EA process includes the basic process steps of aggregating an emulsion containing a polymer binder, an optional wax, an optional colorant, a surfactant, and an optional coagulant to form aggregated particles; freezing the growth of the aggregated particles; coalescing the aggregated particles to form coalesced particles; and then isolating, optionally washing, and optionally drying the toner particles.

In embodiments, the resin latex or emulsion in EA processes can be prepared by any suitable means. For example, the latex or emulsion is prepared by taking the resin and heating it to its melting temperature and dispersing the resin in an aqueous phase containing a surfactant. The dispersion is carried out by various dispersing equipment, such as an ultimizer, high speed homogenizer, or the like to provide submicron resin particles. Other ways to prepare the resin latex or emulsion include solubilizing the resin in a solvent and adding it to heated water to flash evaporate the solvent. External dispersions have also been employed to assist the formation of emulsion as the solvent is being evaporated. Likewise, to incorporate the wax into the toner, it has been known for the wax to be in the form of one or more aqueous emulsions or dispersions of solid wax in water, where the solid wax particle size is usually in the range of from about 100 to about 500 nm, such as from about 150 to about 450 nm, or from about 200 to about 400 nm.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1% to about 8% by weight, specifically from about 0.2% to about 5% by weight, and more specifically from about 0.5% to about 5% by weight of the resin in the mixture. This provides a sufficient amount of agent for aggregation.

When core-shell toner particles are made in any of the above-described EA processes, the core-shell toner particles may have a size of from, about 3 to about 25 μm, such as from about 5 μm to about 20 μm, or from about 8 μm to about 16 μm. The core-shell toner particles of embodiments may also possess a circularity of from about 0.93 to about 1, such as from about 0.95 to about 1, and more specifically from about 0.98 to about 1, and possess a parent toner charge per mass ratio of from about 3 μC/g to about −60 μC/g, specifically from about −6 μC/g to about −45 μC/g, and more specifically from about −9 μC/g to about −30 μC/g.

In embodiments, an optional shell may be applied to the formed aggregated toner particles. Any resin described above as suitable for the core resin may be utilized as the shell resin. The shell resin may be applied to the aggregated particles by any method within the purview of those skilled in the art. In embodiments, the shell resin may be in an emulsion including any surfactant described above. The aggregated particles described above may be combined with said emulsion so that the resin forms a shell over the formed aggregates. In embodiments, a crystalline polyester may be utilized to form a shell over the aggregates to form toner particles having a core-shell configuration.

The shell resin may be present in an amount of from about 10% to about 60% by weight, such as from about 24% to about 50% by weight of the toner particles on a dry weight basis.

Once the desired final size of the toner particles is achieved, the pH of the resulting mixture may be adjusted by an acid such as, for example, acetic acid, nitric acid or the like. In embodiments, the pH of the mixture may be adjusted to from about 6 to about 12, and more specifically from about 7 to about 10. Additionally, in embodiments, the mixture may be homogenized. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) or 3-hydroxy-2,2'-iminodisuccinic acid (HIDS) may be added to help adjust the pH to the desired values noted above. The base may be added in amounts from about 2% to about 25% by weight of the mixture, such as from about 4% to about 10% by weight of the mixture on a dry weight basis.

If the mixture is homogenized, homogenization may be accomplished by mixing at about 600 to about 4,000 revolutions per minute. Homogenization may be accomplished by any suitable means, including for example, an IKA ULTRA TURRAX T50 probe homogenizer.

An optional dilute solution of flocculates or aggregating agents may be used to optimize particle aggregation time with as little fouling and coarse particle formation as possible. Examples of flocculates or aggregating agents may include polyaluminum chloride (PAC), dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL® and ALKAQUAT® (available from Alkaril Chemical Company), SANIZOL® (benzalkonium chloride) (available from Kao Chemicals), and the like, and mixtures thereof.

In embodiments, the flocculates or aggregating agents may be used in an amount of from about 0.01% to about 10% by weight of the toner, specifically from about 0.02% to about 5%, and more specifically from about 0.05% to about 2% by weight of the toner. For example, the latitude of flocculates or aggregating agents around about a centerline particle formulation is about 0.17% by weight, plus or minus, about 0.02% by weight based upon the total weight of the toner.

The EA toner particles formed may comprise of from about 50% to about 99% by weight of the polyester amorphous resin, specifically from about 65% to about 95%, and more specifically from about 10% to about 30% by weight of the polyester amorphous resin on a dry weight basis.

Coalescence

Following aggregation to the desired particle size, with the formation of an optional shell as described above, the particles may then be coalesced to the desired final shape, the coalescence being achieved by, for example, heating the mixture to a temperature of from about 55° C. to about 100° C., such as from about 60° C. to about 95° C., in embodiments from about 65° C. to about 90° C., which may be below the melting point of the crystalline resin to prevent plasticization. Higher or lower temperatures may be used, it being understood that the temperature is a function of the resins used for the binder.

Coalescence may proceed and be accomplished over a period of from about 0.1 to about 9 hours, such as from about 0.5 to about 4 hours.

After coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

EXAMPLES

Example 1

Preparation of Butane-1,4-trans-cinnamate

Butane-1,4-trans-cinnamate of the formula

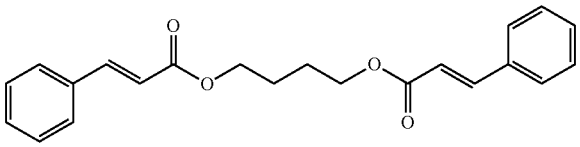

was prepared using a 3-neck 500 mL round-bottomed flask equipped with a dean stark trap and condenser, thermocouple, and argon inlet. In the flask was added trans-cinnamic acid (100 grams, 674 mmol, obtained from Sigma-Aldrich), 1,4-butanediol (30.4 grams, 337 mmol, obtained from Sigma-Aldrich), and FASCAT 4201 dibutyl tin oxide catalyst (0.12 grams, 0.1 wt %, obtained from Arkema Inc.). The mixture was slowly heated under argon to 120° C., during which time the trans-cinnamic acid melted. The temperature was then raised to 180° C., and condensation began around 150° C. The reaction mixture was stirred at 180° C. overnight (about 20 hours). Thereafter, vacuum (1-2 mm-Hg) was applied for about 20 minutes. A total of 5.3 mL water was collected in the dean stark trap. The reaction mixture was cooled under argon to about 100° C. and discharged into an aluminum tray and cooled to room temperature to give 110 grams of product as an off-white solid. The product was transferred to a 500 mL Erlenmeyer flask, to which was added about 125 mL isopropyl alcohol heated to about 85° C., during which the product dissolved. The flask was then cooled to room temperature, during which product crystallized out, was filtered, and dried in a vacuum oven at 60° C. overnight to give 90 grams product as an off-white solid (79% yield). The product was shown to be pure by NMR. Melting temperature (DSC)=95° C.; Crystallization temperature (DSC)=72° C.; Crystallization temperature (rheology)=87° C.

Example 2

Preparation of Emulsion Comprised of Cinnamate Diester and Two Amorphous Polyester Resins (Polyester A and Polyester B)

15.12 grams of cinnamate diester, 27.96 grams of polyester resin A resin and 27.96 grams of polyester resin B were measured into a 2 liter beaker containing about 700 grams of ethyl acetate. The mixture was stirred at about 300 revolutions per minute at room temperature to dissolve the resin in the dichloromethane. 1.56 grams of sodium bicarbonate and 4.53 g of surfactant (DOWFAX® 2A1, Dow Chemical Company 47 wt %) were measured into a 2 liter Pyrex glass flask reactor containing about 700 grams of deionized water. Homogenization of said water solution in said 2 liter glass flask reactor was commenced with an IKA Ultra Turrax T50 homogenizer at 4,000 revolutions per minute. The resin solution was then slowly poured into the water solution as the mixture continued to be homogenized, the homogenizer speed was increased to 8,000 revolutions per minute and homogenization was carried out at these conditions for about 30 minutes. Upon completion of homogenization, the glass flask reactor and its contents were placed in a heating mantle and connected to a distillation device. The mixture was stirred at about 200 revolutions per minute and the temperature of said mixture was increased to 80° C. at about 1° C. per minute to distill off the ethyl acetate from the mixture. Stirring of the said mixture was continued at 80° C. for about 180 minutes followed by cooling at about 2° C. per minute to room temperature. The product was screened through a 25 micron sieve. The resulting resin emulsion was comprised of about 11.08 percent by weight solids in water.

Example 3

Preparation of Toner Comprised of 15% Cinnamate Diester and 6.8% Crystalline Polyester C ($M_w$=23,300, $M_n$=10,500, $T_m$=71° C.)

Into a 2 liter glass reactor equipped with an overhead mixer was added 230.33 grams above emulsion (11.08 wt %) which contains low molecular weight amorphous resin (polyester A), high molecular weight amorphous resin (polymer B) and cinnamate diester, 27.47 grams crystalline resin C emulsion (35.17 wt %), 43.15 grams polyethylene wax dispersion ($T_m$ of 90° C., The International Group, Inc. (IGI)) (29.93 wt %) and 48.77 grams cyan pigment PB15:3 (17.21 wt %). Separately 2.51 grams $Al_2(SO_4)_3$ (27.85 wt %) was added in as the flocculent under homogenization at 3500 revolutions per minute. The mixture was stirred at rpm 300 revolutions per minute, and the particle size was monitored with a Coulter Counter D. The particle size was 5.65 micron with a GSD volume of 1.32 right after flocculent addition at room temperature. Then a mixture of 54.92 grams and 56.72 grams of polyester A emulsion (36.40 wt %) and polyester B resin emulsion (35.25 wt %) were added as shell material, the slurry was then heated to 41° C., resulting in a core-shell structured particles with an average particle size of 6.41 microns, GSD volume 1.23. Thereafter, the pH of the reaction slurry was then increased to 8.3 using 4 wt % NaOH solution followed by 4.62 grams Versene 100, EDTA (39 wt %) to freeze the toner growth. After freezing, the reaction mixture was heated to 78° C., and pH was reduced to 7.74 using pH 5.7 acetic acid/sodium acetate (HAc/NaAc) buffer solution for coalescence. The toner was quenched after coalescence, resulting in a final particle size of 7.49 microns, GSD volume of 1.23. The toner slurry was then cooled to room temperature, separated by sieving (25 micron), filtration, followed by washing, and subsequently freeze dried.

Comparative Example 1

Preparation of Toner Comprised of two amorphous polyester resins (polyester A, with a $M_w$ of 86,000, and $T_g$ onset of 56° C.; and polyester B having a $M_w$ of 19,400 and $T_g$ onset of 60° C.) and 6.8% crystalline polyester C ($M_w$ of 23,300, $M_n$ of 10,500, and $T_m$ of 71° C.), but without cinnamate diester.

Into a 2 liter glass reactor equipped with an overhead mixer was added 230.33 grams above emulsion (11.08 wt %) which contains low molecular weight amorphous resin (polyester A), high molecular weight amorphous resin (polymer B) and cinnamate diester, 27.47 grams crystalline resin C emulsion (35.17 wt %), 43.15 grams polyethylene wax dispersion ($T_m$=90° C., The International Group, Inc. (IGI)) (29.93 wt %) and 48.77 grams cyan pigment PB15:3 (17.21 wt %). Separately 2.51 grains $Al_2(SO_4)_3$ (27.85 wt %) was added in as the flocculent under homogenization at 3500 revolutions per minute. The mixture was stirred at rpm 300 revolutions per minute, and the particle size was monitored with a Coulter Counter D. The particle size was 5.65 micron with a GSD volume of 1.32 right after flocculent addition at room temperature. Then a mixture of 54.92 grams and 56.72 grams of polyester A emulsion (36.40 wt %) and polyester B resin emulsion (35.25 wt %) were added as shell material, the slurry was then heated to 41° C., resulting in a core-shell structured particles with an average particle size of 6.41 microns, GSD volume 1.23. Thereafter, the pH of the reaction slurry was then increased to 8.3 using 4 wt % NaOH solution followed by 4.62 grams Versene 100, EDTA (39 wt %) to freeze the toner growth. After freezing, the reaction mixture was heated to 78° C., and pH was reduced to 7.74 using pH 5.7 acetic acid/sodium acetate (HAc/NaAc) buffer solution for coalescence. The toner was quenched after coalescence, resulting in a final particle size of 7.49 microns, GSD volume of 1.23. The toner slurry was then cooled to room temperature, separated by sieving (25 micron), filtration, followed by washing, and subsequently freeze dried.

Compatibility of Cinnamate Diester and Polyester Resin A

Compatibility studies of the above crystalline cinnamate diester and amorphous toner binding resin (polyester resin A) was investigated by melt mixing the appropriate resins on a hot plate over a 20 minute period (150° C.), followed by cooling and characterization by DSC. Typically, the crystalline resins displays a melting peak at around 70-80° C. whereas the amorphous resin displays a Tg at about 50-60° C. With incompatible resins, both the corresponding Tg and melting point of the mixtures remain unaffected. If the resins are fully compatible, the Tg is depressed and no melting point is observed. For partial compatibility, the Tg is somewhat depressed and the melting point is decreased. To measure the extent of compatibilization, the enthalpy of crystallization is measured. For full compatibility, a value of less than about 0.2 mW is obtained, whereas for full incompatibility, a value of greater than about 4.0 mW is measured by DSC.

Melting Point of Crystalline Cinnamate Diester

The thermal transitions of crystalline cinnamate diester alone was analyzed by differential scanning calorimetry (DSC) and a melting point of about 94.8° C. See FIG. 1.

Enthalpy of Cinnamate Diester

Figure 2:
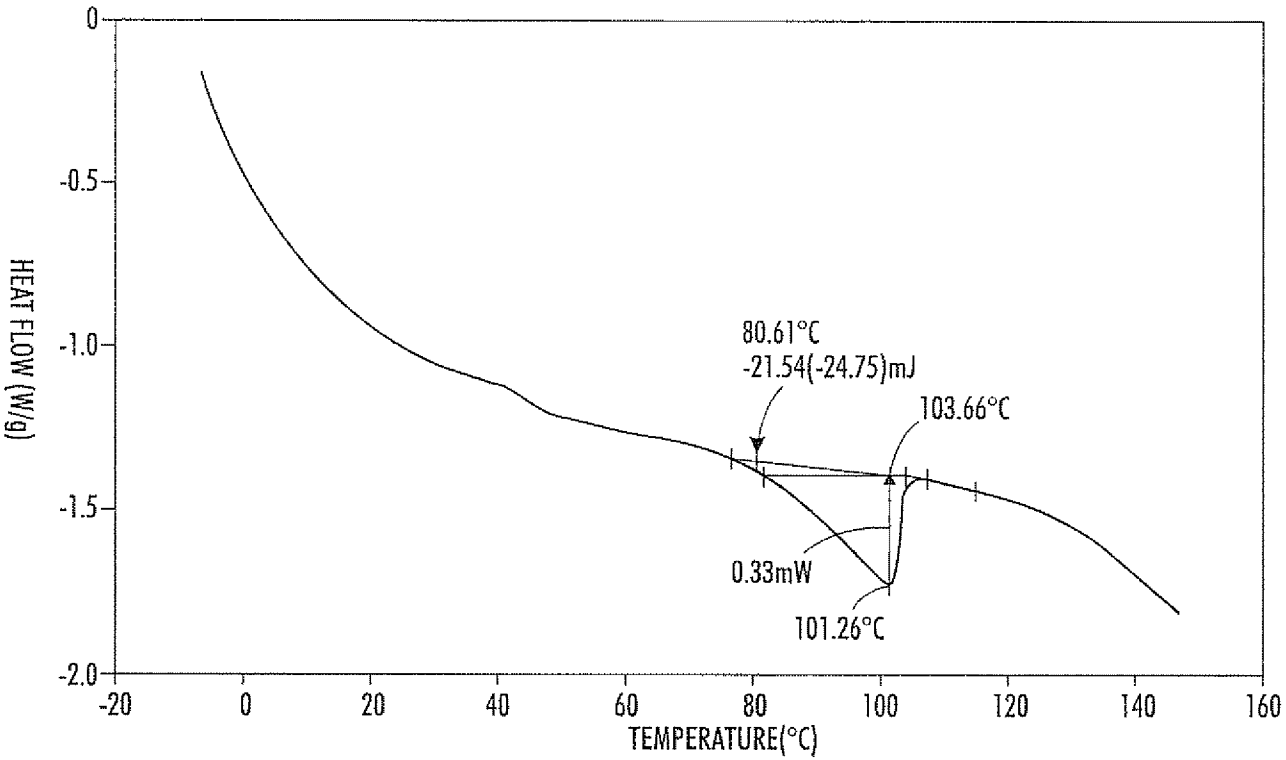
FIG. 2 is a graphic representation of a differential scanning calorimetry curve acquired on a melt mixed cinnamate diester and a propoxylated bisphenol A polyester based resin sample.

The melt mix of cinnamate diester and amorphous resin (polyester resin A) was analyzed by DSC. It can be observed from FIG. 2 that the enthalpy of cinnamate diester is about 0.33 mW, which indicates that cinnamate diester is very compatible with the amorphous resin used in embodiments of the toner design.

Fusing Results

Fusing results of embodiments are provided wherein Comparative Example 1 is a nominal ULM toner containing about 6.8% crystalline polyester (CPE) as a control. Table 1 shows the fusing results of Example 3 together with those of Comparative example 1.

TABLE 1

Fusing Results.

| Experimental Data | Comparative Example 1 Nominal (° C.) | Example 3 10% small molecule (° C.) |
|---|---|---|
| Cold offset on CX+ | 125 | 104 |
| Gloss at MFT on CX+ | 27.8 | 12.9 |
| Gloss at 185° C. on CX+ | N/A | 62.1 |
| Peak Gloss on CX+ | 67.6 | 64.9 |
| T (Gloss 50) on CX+ | 138 | 133 |
| T (Gloss 60) on CX+ | 147 | 148 |

TABLE 1-continued

| Fusing Results. | | |
|---|---|---|
| Experimental Data | Comparative Example 1 Nominal (° C.) | Example 3 10% small molecule (° C.) |
| MFT CA = 80 (extrapolated MFT) | 117 | 104 |
| MFT (Relative to styrene/acrylate control toner fused the same day) | −31 | −47 |
| Hot Offset CX+ 220 mm/s | 186 | 206 |
| Fusing Latitude HOT-MFT on CX+ | 69 | 102 |
| Fix (T G50 & MFT CA-80) | −26 | −33 |

CX+: color xpressions-name of paper
Minimum fusing temperature where crease area is 80
HOT-MFT: hot offset temperature-minimum fusing temperature
T G50: temperature where Gloss is 50.

Crease area measurements were carried out with an image analysis system.

Figure 3:
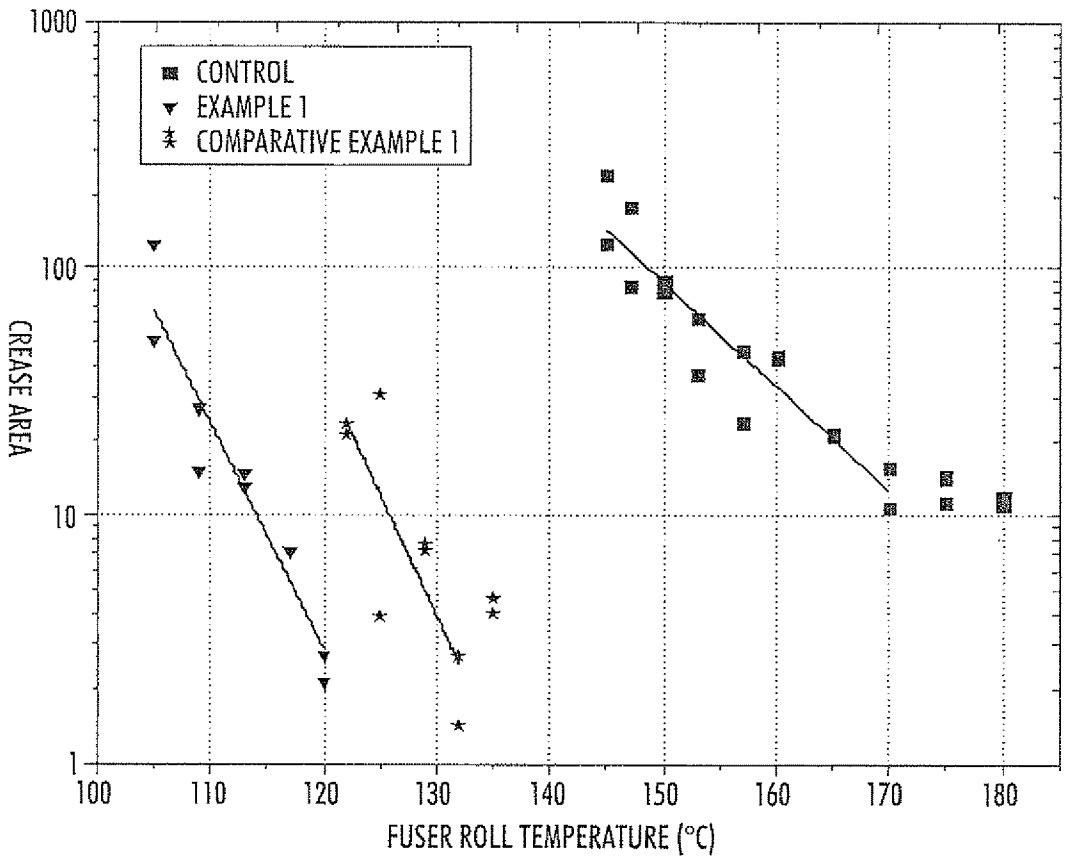
FIG. 3 is a graphic representation of various MFT curves of toners with and without cinnamate diester.

As shown in Table 1 and FIG. 3, by incorporation of the cinnamate diester, the toner cold offset temperature (104° C. versus 125° C.) and crease fix MFT (104° C. versus 117° C.) were shifted to much lower temperatures relative to nominal ultra low melt toner as shown in Table 1. The hot offset temperature was higher (206° C. versus 186° C.), which resulted in much larger fusing latitude (102° C. versus 69° C.).

Gloss

Figure 4:
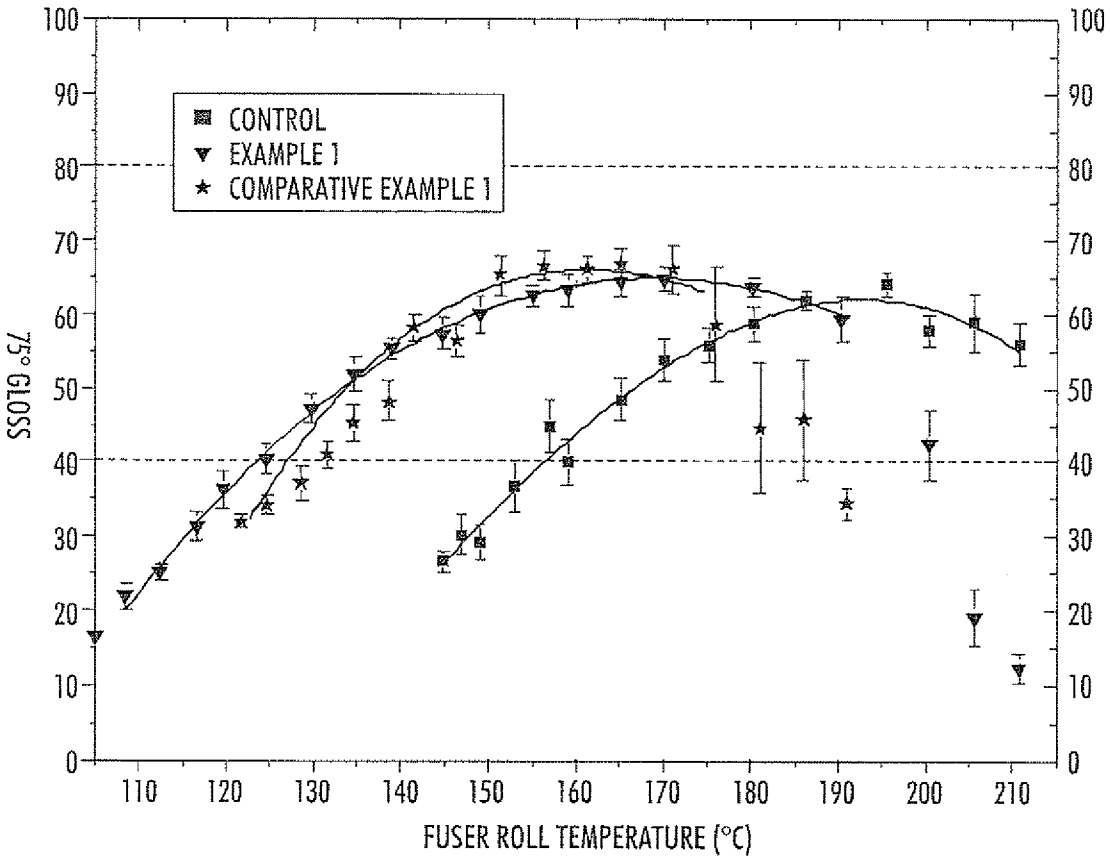
FIG. 4 is a graphic representation gloss plotted against fusing temperature of a control toner composition, a composition with small crystalline molecules and a composition with a crystalline polyester resin.

Print gloss as a function of fuser roll temperature was measured with a BYK Gardner 75° gloss meter. Gloss curves were obtained for toners with and without cinnamate diester. As shown in FIG. 4, the toner containing small molecule cinnamate diester has a similar gloss curve to the nominal ultra low melt control toner.

Developer Charging Results

Toner charging results were obtained by preparing a developer at 5% toner concentration with respect to the weight of the total developer using the XEROX® WC7556 carrier. After conditioning separate samples overnight in a low-humidity zone (J zone) at about 21.1° C./10% relative humidity, and a high humidity zone (A zone) at about 28° C./85% relative humidity, the developers were charged in a Turbula mixer for 60 minutes. The toner charge was measured in the form of q/d, the charge to diameter ratio. The Q/d was measured using a charge spectrograph with a 100 V/cm field, and was measured visually as the midpoint of the toner charge distribution. The charge was reported in millimeters of displacement from the zero line (mm displacement can be converted to femtocoulombs/micron (fC/μm) by multiplying by 0.092).

The parent toner charge per mass ratio (Q/m) was also determined by the total blow-off charge method, measuring the charge on a faraday cage containing the developer after removing the toner by blow-off in a stream of air. The total charge collected in the cage is divided by the mass of toner removed by the blow-off, by weighing the cage before and after blow-off to give the Q/m ratio.

Toner samples were blended with additives and bench tested with a carrier (described above). Q/d and Q/m charging results are shown in Table 2 (below). With additives on the particle, the Q/d is slightly lower than the controls. However, it is known that by optimizing toner A/C processes, with narrow toner GSD numbers, Q/d will be improved and become close to the control toner. The Q/m of the experimental sample looks similar to the control toner.

TABLE 2

| Charging Results. | | | | | | |
|---|---|---|---|---|---|---|
| | 60' charging with additives, 6 pph TC | | | | | |
| | A-zone | | J-zone | | RH ratio | |
| | Az 60' Q/d | Az 60' Q/m | Jz 60' Q/d | Jz 60' Q/m | 60' RH Q/d | 60' RH Q/m |
| Control | 8.4 | 41 | 14.8 | 71 | 0.56 | 0.57 |
| Exemplary Developer | 5.0 | 38 | 12.2 | 73 | 0.41 | 0.52 |

Fusing results and charging results show that by incorporating cinnamate diester into the toner, crease fix MFT was reduced successfully to a crease fix MFT of about −40° C. with little effect on toner charging properties. The unexpected benefit of using this small molecule biodegradable crystalline material is the enhanced fusing latitude, the cold offset temperature was reduced relative to the control and the hot offset temperature was increased relative to the control.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A toner composition comprising toner particles, the toner particles comprising:

at least one small crystalline molecule;

at least one amorphous resin; and optionally, one or more ingredients selected from the group consisting of waxes, pigments, and combinations thereof, wherein the at least one small crystalline molecule is one or more trans-cinnamic diesters having the following general formula:

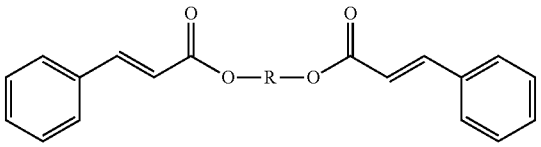

where R is:

(a) an alkylene group, including substituted and unsubstituted alkylene groups, wherein hetero atoms either may or may not be present in the alkylene group;

(b) an arylene group, including substituted and unsubstituted arylene groups, wherein hetero atoms either may or may not be present in the arylene group;

(c) an arylalkylene group, including substituted and unsubstituted arylalkylene groups, wherein hetero atoms either may or may not be present in either or both of the alkyl portion and the aryl portion of the arylalkylene group; or (d) an alkylarylene group, including substituted and unsubstituted alkylarylene groups, wherein hetero atoms either may or may not be present in either or both of the alkyl portion and the aryl portion of the alkylarylene group;

wherein two or more substituents can be joined together to form a ring.

2. The toner composition of claim 1, wherein the at least one small crystalline molecule is propane-1,3-trans-cinnamate, butane-1,4-trans-cinnamate, hexane-1,6-trans-cinnamate, trans-cyclohexane-1,4-dimethanol-trans-cinnamate, para-phenyl 1,4-dimethanol-trans-cinnamate, bis(hydroxymethyl)furan-trans-cinnamate, 2,5-dihydroxymethyltetrahydrofuran-trans-cinnamate, or a mixture thereof.

3. The toner composition of claim 1, wherein the at least one small crystalline molecule is present in an amount up to about 50% by weight of the toner particles on a dry weight basis.

4. The toner composition of claim 1, wherein the at least one amorphous resin is selected from the group consisting of polyesters, polyamides, polyimides, polyisobutyrates, polyolefins, and combinations thereof.

5. The toner composition of claim 1, wherein a mixture of the at least one small crystalline molecule and at least one amorphous resin exhibits an enthalpy of crystallization less than about 1.0 mW.

6. The toner composition of claim 1, wherein the toner composition has a crease fix minimum fusing temperature (MFT) of from about 100° C. to about 140° C.

7. The toner composition of claim 1, wherein the toner particles are of a size of from about 3 to about 25 μm, has a circularity of from about 0.93 to about 1, and possess a parent toner charge per mass ratio of from about −3 μC/g to about −60 μC/g.

8. An emulsion aggregation toner composition comprising toner particles, the toner particles comprising:

at least one small crystalline molecule;

at least one amorphous resin; and optionally, one or more ingredients selected from the group consisting of waxes, coagulants, pigments, and combinations thereof, wherein the at least one small crystalline molecule is one or more trans-cinnamic diesters having the following general formula:

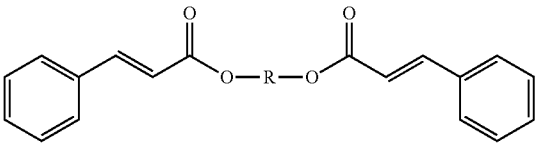

where R is:

(a) an alkylene group, including substituted and unsubstituted alkylene groups, wherein hetero atoms either may or may not be present in the alkylene group;

(b) an arylene group, including substituted and unsubstituted arylene groups, wherein hetero atoms either may or may not be present in the arylene group;

(c) an arylalkylene group, including substituted and unsubstituted arylalkylene groups, wherein hetero atoms either may or may not be present in either or both of the alkyl portion and the aryl portion of the arylalkylene group; or (d) an alkylarylene group, including substituted and unsubstituted alkylarylene groups, wherein hetero atoms either may or may not be present in either or both of the alkyl portion and the aryl portion of the alkylarylene group;

wherein two or more substituents can be joined together to form a ring.

9. The toner composition of claim 8, wherein the at least one small crystalline molecule is propane-1,3-trans-cinnamate, butane-1,4-trans-cinnamate, hexane-1,6-trans-cinnamate, trans-cyclohexane-1,4-dimethanol-trans-cinnamate, para-phenyl 1,4-dimethanol-trans-cinnamate, bis(hydroxymethyl)furan-trans-cinnamate, 2,5-dihydroxymethyltetrahydrofuran-trans-cinnamate, or a mixture thereof.

10. The toner composition of claim 8, wherein the at least one small crystalline molecule is present in an amount up to about 50% by weight of the toner particles on a dry weight basis.

11. The toner composition of claim 8, wherein the at least one amorphous resin is selected from the group consisting of polyesters, polyamides, polyimides, polyisobutyrates, polyolefins, and combinations thereof.

12. The toner composition of claim 8, wherein the at least one amorphous resin further comprises a crystalline polyester resin in an amount from 1% to 30% by weight of the toner particles on a dry weight basis.

13. The toner composition of claim 8, wherein the toner composition has a crease fix minimum fusing temperature of from about 100° C. to about 140° C.

14. The toner composition of claim 8, wherein the toner particles are of a size of from about 3 to about 25 μm, has a circularity of from about 0.93 to about 1, and possess a parent toner charge per mass ratio of from about −3 μC/g to about −60 μC/g.

15. An emulsion aggregation process for preparing the toner composition of claim 1, the process comprising:

contacting at least one amorphous resin with at least one small crystalline molecule in a mixture; and contacting the mixture with one or more ingredients selected from the group consisting of waxes, coagulants, pigments, and combinations thereof to form toner particles, wherein the at least one small crystalline molecule is one or more trans-cinnamic diesters having the following general formula:

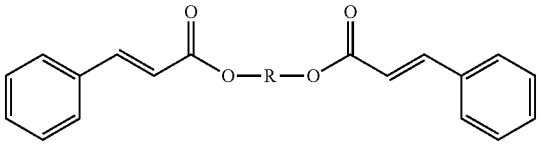

where R is:

(a) an alkylene group, including substituted and unsubstituted alkylene groups, wherein hetero atoms either may or may not be present in the alkylene group;

(b) an arylene group, including substituted and unsubstituted arylene groups, wherein hetero atoms either may or may not be present in the arylene group;

(c) an arylalkylene group, including substituted and unsubstituted arylalkylene groups, wherein hetero atoms either may or may not be present in either or both of the alkyl portion and the aryl portion of the arylalkylene group; or (d) an alkylarylene group, including substituted and unsubstituted alkylarylene groups, wherein hetero atoms either may or may not be present in either or both of the alkyl portion and the aryl portion of the alkylarylene group;

wherein two or more substituents can be joined together to form a ring.

16. A process according to claim 15, further comprising:

aggregating the at least one amorphous resin and the at least one small crystalline molecule mixture and one or more ingredients to form core particles;

contacting the core particles with an emulsion comprising the at least one amorphous resin to form a shell over the particles; and coalescing the particles to form toner particles; wherein the toner has a crease fix minimum fusing temperature of from about 100° C. to about 140° C.

17. The process of claim 15, wherein the at least one small crystalline molecule is propane-1,3-trans-cinnamate, butane-1,4-trans-cinnamate, hexane-1,6 trans-cinnamate, trans-cyclohexane-1,4-dimethanol-trans-cinnamate, para-phenyl 1,4-dimethanol-trans-cinnamate, bis(hydroxymethyl)furan-trans-cinnamate, 2,5-dihydroxymethyl-tetrahydrofuran-trans-cinnamate, or a mixture thereof.

18. The process of claim 15, wherein the at least one small crystalline molecule is present in an amount up to about 50% by weight of the recovered toner particles on a dry weight basis.

19. The process of claim 15, wherein the at least one amorphous resin further comprises a crystalline polyester resin in an amount from 1% to 30% by weight of the recovered toner particles on a dry weight basis.

20. The process of claim 15, wherein the at least one amorphous resin is selected from the group consisting of polyesters, polyamides, polyimides, polyisobutyrates, polyolefins, and combinations thereof.

* * * * *